US009966664B2

(12) United States Patent
Katipally et al.

(10) Patent No.: US 9,966,664 B2
(45) Date of Patent: May 8, 2018

(54) LOW BAND AND HIGH BAND DIPOLE DESIGNS FOR TRIPLE BAND ANTENNA SYSTEMS AND RELATED METHODS

(71) Applicants: Raja Reddy Katipally, Chesire, CT (US); Aaron T. Rose, Hamden, CT (US)

(72) Inventors: Raja Reddy Katipally, Chesire, CT (US); Aaron T. Rose, Hamden, CT (US)

(73) Assignee: Alcatel-Lucent Shanghai Bell Co., Ltd., Shanghai (CN)

( * ) Notice: Subject to any disclaimer, the term of this patent is extended or adjusted under 35 U.S.C. 154(b) by 428 days.

(21) Appl. No.: 13/669,040

(22) Filed: Nov. 5, 2012

(65) Prior Publication Data

US 2014/0125539 A1 May 8, 2014

(51) Int. Cl.

| | |
|---|---|
| ***H01Q 5/00*** | (2015.01) |
| ***H01Q 21/06*** | (2006.01) |
| ***H01Q 21/26*** | (2006.01) |
| ***H01Q 21/28*** | (2006.01) |
| ***H01Q 5/42*** | (2015.01) |
| ***H01Q 5/48*** | (2015.01) |

(52) U.S. Cl.

CPC ..... *H01Q 5/42* (2015.01); *H01Q 5/48* (2015.01); *H01Q 21/062* (2013.01); *H01Q 21/26* (2013.01); *H01Q 21/28* (2013.01); *Y10T 29/49016* (2015.01)

(58) Field of Classification Search

CPC H01Q 21/26; H01Q 5/42; H01Q 5/48; H01Q 21/062

See application file for complete search history.

(56) References Cited

U.S. PATENT DOCUMENTS

| | | | | |
|---|---|---|---|---|
| 6,025,798 | A * | 2/2000 | Colombel | H01Q 1/523 342/361 |
| 6,313,809 | B1 * | 11/2001 | Gabriel et al. | 343/797 |
| 7,443,356 | B2 * | 10/2008 | Roberts et al. | 343/797 |
| 2002/0163477 | A1 | 11/2002 | Eriksson et al. | |

(Continued)

FOREIGN PATENT DOCUMENTS

| | | |
|---|---|---|
| WO | WO2012092889 | 7/2012 |

*Primary Examiner* — Daniel J Munoz

(74) *Attorney, Agent, or Firm* — The Capitol Patent & Trademark Law Firm, PLLC

(57) ABSTRACT

Multi-band antenna systems for communication systems are disclosed. An antenna system includes at least one low band dipole radiating element for radiating RF energy in a low frequency range and at least one group or column of high band dipole radiating assemblies for radiating RF energy in a high frequency range. The low band dipole radiating element may be constructed to provide improved control beam width stability of the high band dipole radiating assemblies and improved cross-polarization performance in the low frequency range. The high band dipole radiating assemblies include high band dipole radiating elements and shrouds surrounding the high band dipole radiating elements. The shrouds are configured to improve the beam width stability and cross-polarization of the high band dipole radiating elements, improve isolation between the high band dipole radiating elements and to shift resonance of the high band dipole radiating assemblies below the low frequency range.

33 Claims, 9 Drawing Sheets

(56) References Cited

U.S. PATENT DOCUMENTS

| | | | | |
|---|---|---|---|---|
| 2004/0004579 | A1* | 1/2004 | Manzione et al. | 343/893 |
| 2005/0253769 | A1* | 11/2005 | Timofeev | H01Q 1/246 343/797 |
| 2006/0114168 | A1* | 6/2006 | Gottl et al. | 343/797 |
| 2007/0146225 | A1* | 6/2007 | Boss et al. | 343/797 |
| 2007/0152901 | A1 | 7/2007 | Hockey et al. | |
| 2007/0241983 | A1 | 10/2007 | Cao et al. | |
| 2011/0279339 | A1* | 11/2011 | Johnston | 343/786 |

* cited by examiner

1
L
W
10
40
50
22
24
26
28
30
32
34
36
38
40
42
44
46
48
50
52
54
56
58
60
62
64
66
68
70
72
74
76
78
80
82
84
86
88
90
92
94
96
98
100

LOW BAND AND HIGH BAND DIPOLE DESIGNS FOR TRIPLE BAND ANTENNA SYSTEMS AND RELATED METHODS

BACKGROUND

Antennas with dipole radiating elements (dipoles), both low frequency band ("low band" or "LB") and high frequency band ("high band" or "HB"), are commonly used in the communications industry. Conventional dipoles, such as half wavelength dipoles with V-shaped, U-shaped, "butterfly", "bow tie" or "four square" arm structures are described in several known publications.

Particularly, panel-type base station antennas, such as those used in mobile communication systems, are often dual polarization antennas. That is, these antennas often radiate radio frequency (RF) signals/energy on two opposite polarizations. Most dual polarization antennas are made with dual polarized elements, either by including a single patch element fed in such a manner to create a dual polarized structure, or by combining two linear polarized dipoles into one, thereby making a single, dual polarization element.

Conventional, dual polarization dipole radiating elements often have problems with beam width stability. It is, therefore, desirable to provide antennas with dipole radiating elements having improved beam width stability.

Additionally, many conventional panel-type base station antennas are multi-band (e.g., dual band or triple band) antennas. These antennas are configured to operate in two or more frequency bands, often with one or more groups or columns of dipole radiating elements operating within a low frequency range, and one or more groups or columns of dipole radiating elements operating in a high frequency band. In such antennas, there are often problems with resonance from high band dipole radiating elements creating interference with low band frequencies. It is therefore desirable to provide antennas with reduced low band interference due to resonance from high band radiating elements.

It is further desirable to improve cross-polarization (ratio of power in a desired polarization to power in the opposite polarization) in dipole antennas.

Still further, antennas that include a plurality of dipole radiating elements may experience issues with poor isolation between adjacent radiating elements. It is, therefore, desirable to provide features that improve isolation between opposite polarities of adjacent radiating elements in antennas.

It is further desirable to provide antennas having the aforementioned benefits that are easy and cost-effective to manufacture.

SUMMARY

Exemplary embodiments of antennas for mobile communication systems, and methods for assembling such antennas, are disclosed.

According to an embodiment, an antenna radiating element for a mobile communication antenna comprises a base portion configured to be attached to a chassis and at least two forked arms attached to the base portion. Each of the at least two forked arms includes a proximal end connected to the base portion, a distal end radially spaced from the base portion, a first radial arm portion extending radially from the proximal end to the distal end, and a second radial arm portion connected to the first radial arm portion at a vertex of the proximal end and extending radially from the proximal end to the distal end. Each of the at least two forked arms further includes a first transverse arm portion connected to the first radial arm portion at the distal end, and a second transverse arm portion connected to the second radial arm portion at the distal end. The first transverse arm portion extends transversely to the first radial arm portion in a first horizontal direction, while the second transverse arm portion extends transversely to the second radial arm portion in a second horizontal direction substantially opposite the first horizontal direction.

According to another embodiment, an antenna comprises a chassis, at least one low band radiating element mounted on the chassis and at least one first high band radiating assembly mounted on the chassis in a first column in side-by-side relationship with the at least one low band radiating element. The at least one low band radiating element is configured to transmit and receive RF signals in a low frequency range, while the at least one first high band radiating assembly is configured to transmit and receive RF signals in a high frequency range. The at least one first high band radiating assembly includes a first high band radiating element and a first shroud surrounding the first high band radiating element.

According to yet another embodiment, a method of assembling an antenna comprises mounting at least one low band radiating element mounted on a chassis and mounting at least one first high band radiating assembly the chassis in a first column in side-by-side relationship with the at least one low band radiating element. The at least one low band radiating element is configured to transmit and receive RF signals in a low frequency range, while the at least one first high band radiating element is configured to transmit and receive RF signals in a high frequency range. The at least one first high band radiating assembly includes a first high band radiating element and a first shroud surrounding the first high band radiating element.

Additional features and advantages of the inventions will be apparent from the following detailed description and appended drawings.

DETAILED DESCRIPTION, INCLUDING EXAMPLES

Figure 1:
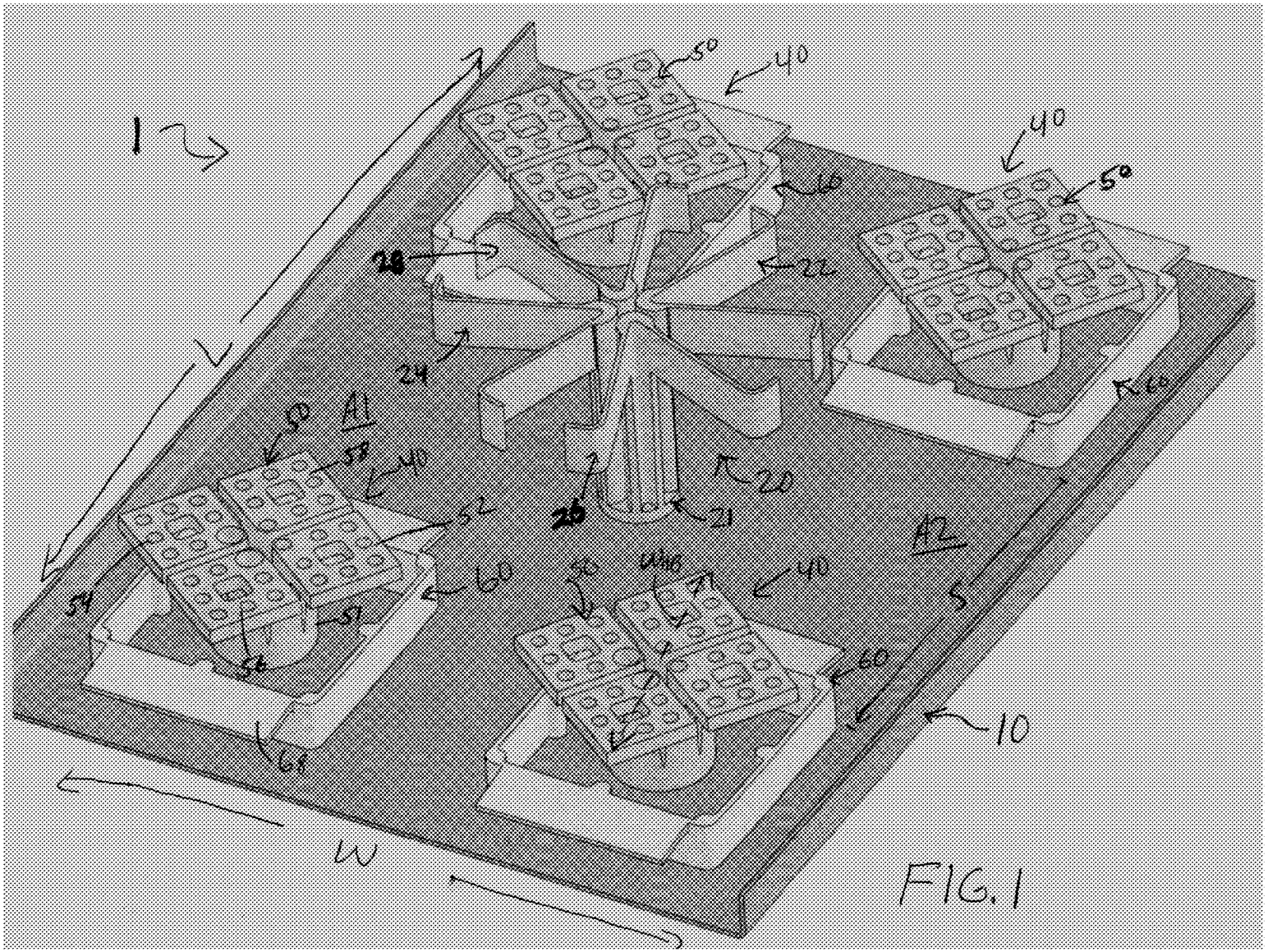
FIG. 1 is a perspective view of an antenna according to an embodiment of the invention.

Exemplary embodiments of an antenna, antenna components and related methods are described herein in detail and shown by way of example in the drawings. Throughout the following description and drawings, like reference numbers/characters refer to like elements.

It should be understood that, although specific exemplary embodiments are discussed herein there is no intent to limit the scope of present invention to such embodiments. To the contrary, it should be understood that the exemplary embodiments discussed herein are for illustrative purposes, and that modified, equivalent and alternative embodiments may be implemented without departing from the scope of the present invention.

Specific structural and functional details disclosed herein are merely representative for purposes of describing the exemplary embodiments. The inventions, however, may be embodied in many alternate forms and should not be construed as limited to only the embodiments set forth herein.

It should be noted that some exemplary embodiments are described as processes or methods depicted in flowcharts. Although the flowcharts may describe the processes/methods as sequential, many of the processes/methods may be performed in parallel, concurrently or simultaneously. In addition, the order of each step within processes/methods may be re-arranged. The processes/methods may be terminated when completed, and may also include additional steps not included in a flowchart. The processes/methods may correspond to functions, procedures, subroutines, subprograms, etc completed by an antenna, antenna component and/or antenna system.

It should be understood that, although the terms first, second, etc. may be used herein to describe various elements, these elements should not be limited by these terms. These terms are used merely to distinguish one element from another. For example, a first element could be termed a second element, and, similarly, a second element could be termed a first element, without departing from the scope of disclosed embodiments. As used herein, the term "and/or" includes any and all combinations of one or more of the associated listed items. It should be understood that when an element is referred to as being "connected" or "attached" to another element, it may be directly connected or attached to the other element or intervening elements may be present, unless otherwise specified. Other words used to describe connective or spatial relationships between elements or components (e.g., "between," "adjacent," etc.) should be interpreted in a like fashion. As used herein, the singular forms "a," "an" and "the" are intended to include the plural forms as well, unless the context clearly indicates otherwise.

Unless specifically stated otherwise, or as is apparent from the discussion, terms such as "processing" or "computing" or "calculating" or "determining" of "displaying" or the like, refer to the action and processes of a computer system, or similar electronic computing device, that manipulates and transforms data represented as physical, electronic quantities within the computer system's registers and memories, for example, into other data similarly represented as physical quantities within the computer system memories or registers or other such information storage, transmission or display devices.

As used herein, the term "embodiment" refers to an embodiment of the present invention. Further, the phrase "base station" may describe, for example, a transceiver in communication with, and providing wireless resources to, mobile devices in a wireless communication network which may span multiple technology generations. As discussed herein, a base station includes the functionally typically associated with well-known base stations in addition to the capability to perform the features, functions and methods discussed herein.

FIG. 1 shows an exemplary antenna 1 for a communication system according to an embodiment. The antenna 1 may be, for example, a base station panel antenna for a mobile communication system. As shown in FIG. 1, the antenna 1 may be a triple band antenna including a reflector plate or chassis 10, a low band dipole radiating element 20 (hereinafter "low band dipole") mounted on the chassis 10, a first array or column A1 of high band dipole radiating assemblies 40 (hereinafter "high band dipole assemblies") mounted on the chassis 10 and a second array or column A2 of high band dipole assemblies 40 mounted on the chassis 10. The low band dipole 20 may be configured and may be operable to transmit and/or receive radio frequency (RF) energy/signals in a low frequency range, and the high band dipole assemblies are configured and operated to transmit and/or receive RF energy/signals in a high frequency range. According to one exemplary embodiment, the low band element 20 may be operated at frequencies of about 698 MHz to about 960 MHz and the high band dipole assemblies 40 may be operated at frequencies of about 1700 to about 2700 MHz. It should be understood, however, that alternative embodiments with different operating frequencies are possible.

Still referring to FIG. 1, the antenna 1 comprises a side-by-side configuration of dipole arrays. More specifically, the high band dipole assemblies 40 in columns A1 and A2 may be arranged side-by-side with the low band dipoles 20. Each column A1 and A2 is shown with two high band assemblies 40. In the embodiment depicted in FIG. 1, the low band dipole 20 is shown disposed generally at the middle of the antenna 1/chassis 10 with respect to the width W of the antenna 1/chassis 10, while the columns A1 and A2 are shown disposed on opposite sides of the low band dipole 20 and extending along the length L of the antenna 1/chassis 10 from one end of the antenna 1 to the other end of the antenna 1. The low band dipole 20 is also shown to be located generally midway along a length of the columns A1 and A2, between adjacent high band dipole assemblies 40 in each column A1, A2. Said another way, the low band dipole 20 is shown to be centrally located within the arrangement of dipoles 20, 40. According to one embodiment, the high band dipole assemblies 40 may be spaced apart along the length their respective columns by a distance S of approximately one wavelength ($\lambda$) of a selected operating frequency within the high frequency range. Because there may be many possible operating frequencies within the high band frequency range, the spacing of the high band dipole assemblies 40 in columns A1 and A2 may be variable, and may be optimized for a given application. It should be understood that the spacing and arrangement of the low band dipole 20 and high band dipole assemblies 40 may be changed from that shown in FIG. 1 in alternate embodiments.

The structure shown in FIG. 1 may be a periodic structure that may be repeated as many times as desired in order for the antenna 1 to meet desired specifications. In other words, the structure shown in FIG. 1 may be extended to provide a longer antenna with a greater number of low band dipoles 20 and high band dipole assemblies 40. According to embodiment, it may be desirable to maintain approximately a 2:1 ratio of the number of high band dipole assemblies in each column A1, A2 to low band dipoles 20. However, it should be understood that it may be possible to provide an antenna comprising any number of low band dipoles 10 and any number of high band dipole assemblies 40. It should also be understood that it may be possible to eliminate one of the rows A1, A2 to form a dual band antenna rather than the triple band antenna 1.

Still referring to FIG. 1, the chassis 10 may be a unitary structure, or it may be constructed of multiple parts that are fastened or soldered together, for example. The chassis 10 may be constructed of any conductive material, such as aluminum, copper, bronze or zamak, for example. However, it should be understood that the chassis 10 may be constructed of other materials.

Figure 2:
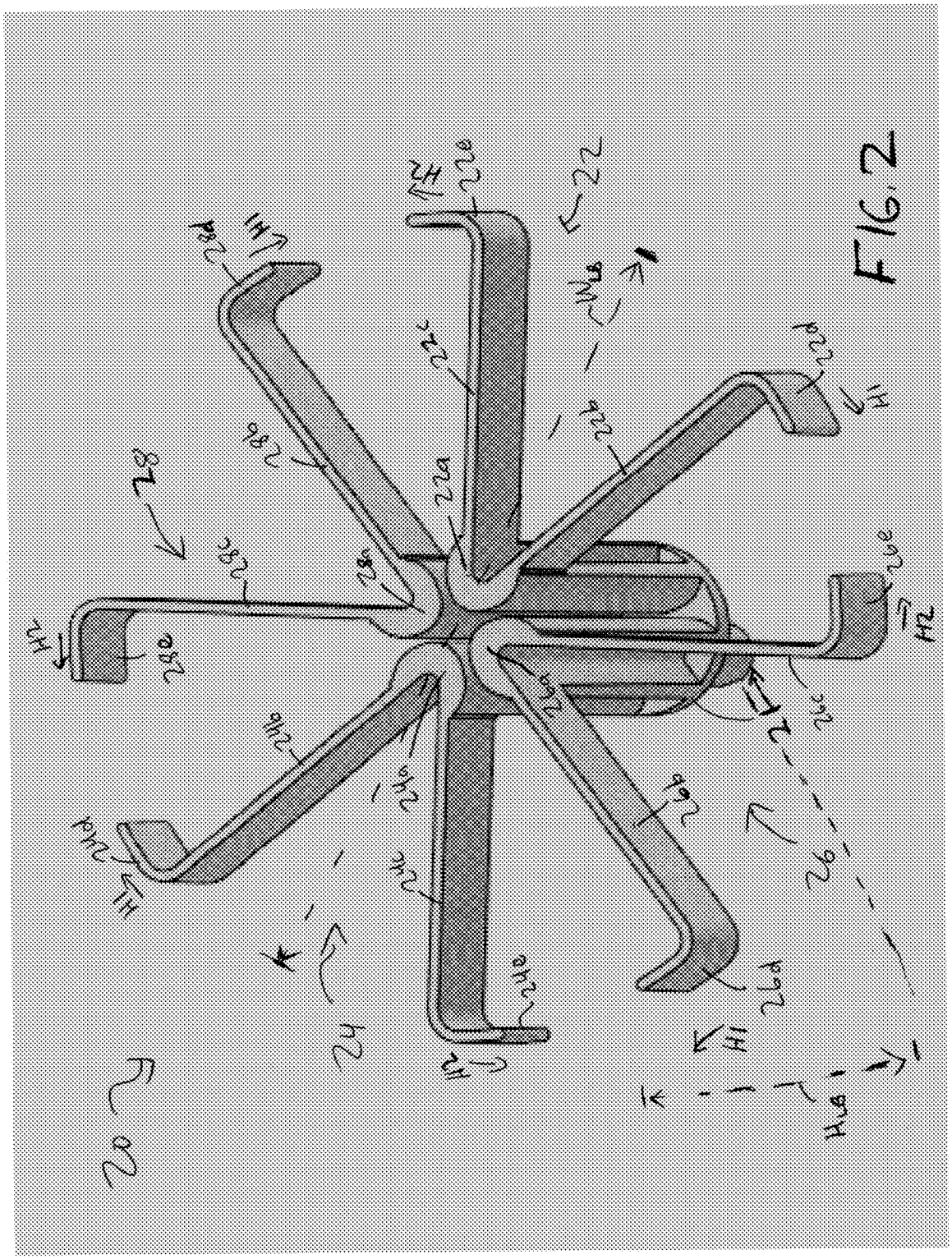
FIG. 2 is a perspective view of a low band dipole radiating element of the antenna of FIG. 1 according to an embodiment of the invention.

FIG. 2 depicts the low band dipole 20 in greater detail according to an embodiment of the invention. The low band dipole 20 may be constructed as a unitary structure. The construction of the low band dipole 20 may be accomplished by, for example, molding, casting, or carving. In addition, the low band dipole 20 may be constructed using materials such as copper, bronze, plastic, aluminum, or a zamak alloy, for example. If the material used is a type that cannot be soldered, such as plastic or aluminum, then the low band dipole 20, once formed, may be covered or plated, in part or in whole, with a metallic material that may be soldered, such as copper, silver, or gold.

Still referencing FIG. 2, the low band dipole 20 may include forked arms. In the embodiment depicted in FIG. 2 the forked arms comprise four V-shaped or U-shaped arms 22, 24, 26, 28 attached to a base portion 21. The base portion 21 of the low band dipole may be attached to the chassis 10 by fasteners (e.g., screws) or soldering, for example. Each arm 22, 24, 26, 28 may include a vertex portion 22*a*, 24*a*, 26*a*, 28*a* of the V or U shape at a proximal end of the arm. The vertex portion 22*a*, 24*a*, 26*a*, 28*a* may be attached to the base portion 21, while the arm 22, 24, 26, 28 may extend radially outward therefrom to a distal end of the arm.

The arms 22, 24, 26, and 28 may be arranged such that arm 22 is opposite arm 24, and arm 26 is opposite arm 28. The opposing arms may be wired (not shown) and positioned with respect to the base portion 21 (and the chassis 10) so as to transmit and/or receive RF energy/signals at two polarizations: a first polarization of +45 degrees and a second polarization of −45 degrees with respect to the base portion 21, for example. Opposing arms 24 and 22 may correspond to the first and second polarization of the dipole 20, respectively. Likewise, opposing arms 28 and 26 may correspond to the first and second polarizations, respectively. It should be understood that low band dipole 20 is not limited to these polarizations, and it is understood that changing the number, arrangement and position of the arms may change both the number of polarizations and the polarization angles of the dipole.

Each of the arms 22, 24, 26, and 28 may include a first radial arm portion 22*b*, 24*b*, 26*b*, 28*b* a second radial arm portion 22*c*, 24*c*, 26*c*, 28*c* connected to each other at the vertex portion 22*a*, 24*a*, 26*a*, 28*a* extending radially from the vertex portion 22*a*, 24*a*, 26*a*, 28*a* to the distal end of the arm 22, 24, 26, 28. A first transverse arm portion 22*d*, 24*d*, 26*d*, 28*d* may be connected to the first radial arm portion 22*b*, 24*b*, 26*b*, 28*b* at the distal end of the arm 22, 24, 26, 28 and extend transversely to the first radial arm portion 22*b*, 24*b*, 26*b*, 28*b* in a first direction H1 (e.g., horizontal). A second transverse arm portion 22*e*, 24*e*, 26*e*, 28*e* may be connected to the second radial arm portion 22*c*, 24*c*, 26*c*, 28*c* at the distal end of the arm 22, 24, 26, 28 and extend transversely to the second radial arm portion 22*c*, 24*c*, 26*c*, 28*c* in a second direction H2 (e.g., horizontal) substantially opposite the first horizontal direction H1. In other words, the first transverse arm portions 22*d*, 24*d*, 26*d*, 28*d* and second transverse arm portions 22*e*, 24*e*, 26*e*, 28*e* may diverge from each other. According to one embodiment, the first transverse arm portions 22*d*, 24*d*, 26*d*, 28*d* may be substantially perpendicular to the respective first radial arm portions 22*b*, 24*b*, 26*b*, 28*b* and the second transverse arm portions 22*e*, 24*e*, 26*e*, 28*e* may be substantially perpendicular to the second radial arm portions 22*c*, 24*c*, 26*c*, 28*c*.

Figure 5:
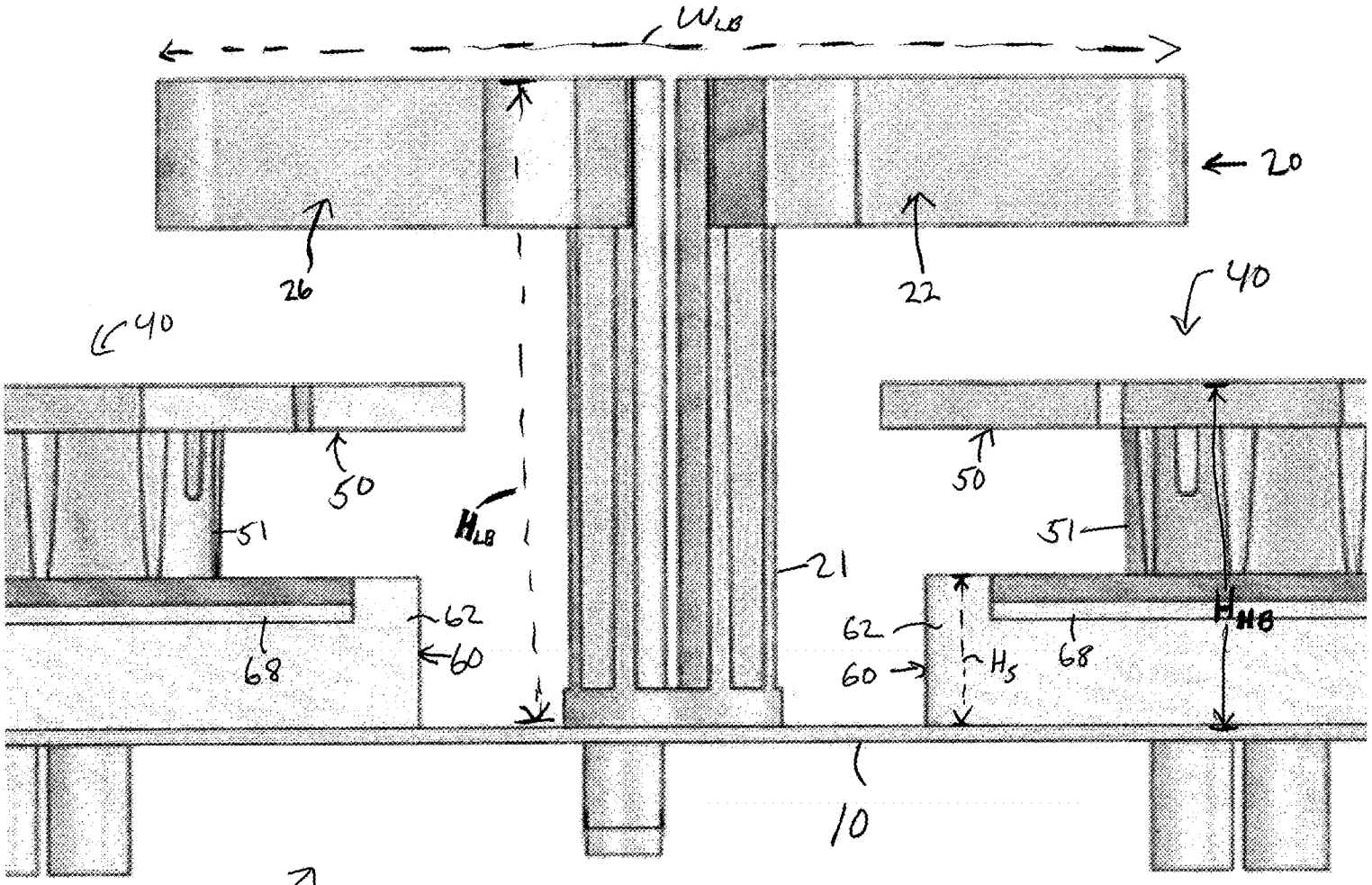
FIG. 5 is a cross-sectional end view of the antenna of FIG. 1 according to an embodiment of the invention.

Referring to FIGS. 2 and 5, according to an embodiment, the wingspan $W_{LB}$ of the arms 22, 24, 26, 28 may be about one-half of the wavelength (λ/2) of an operating frequency within a low frequency range. In order to minimize signal interference between the low band dipole 20 and the high band dipole assemblies 40, it may be preferable to position the low band dipole 20 on the chassis 10 such that the arms 22, 24, 26 and 28 do not extend into the space directly above the high band dipole assemblies or, at most, extend only minimally into the space directly above the high band dipole assemblies 50. The electrical height $H_{LB}$ of the low band dipole 20 may be about one-fourth of the wavelength (λ/4) of an operating frequency within the low frequency range. However, the size and shape of the low band dipole 20 and the arms 22, 24, 26, 28 may vary from antenna to antenna and still be within the scope of the invention.

The base portion 21 of the low band dipole 20 may be designed and shaped to match a complimentary form on the chassis 10 so as to further facilitate the assembly of the antenna structure. One skilled in the art would appreciate that the size and shape of the base portion 21 may vary from antenna to antenna and still be within the scope of the invention.

Turning back to FIG. 1, each of the high band dipole assemblies 40 may include a high band dipole radiating element 50 (hereinafter "high band dipole") and a shroud or baffle 60 surrounding the high band dipole 50. As described later in more detail, the shroud 60 may be configured to improve isolation between adjacent high band dipole assemblies 40, improve beam width stability and cross-polarization of the high band dipole assemblies 40 and reduce low frequency resonance problems that exist with high band dipoles in conventional antennas.

Figure 3:
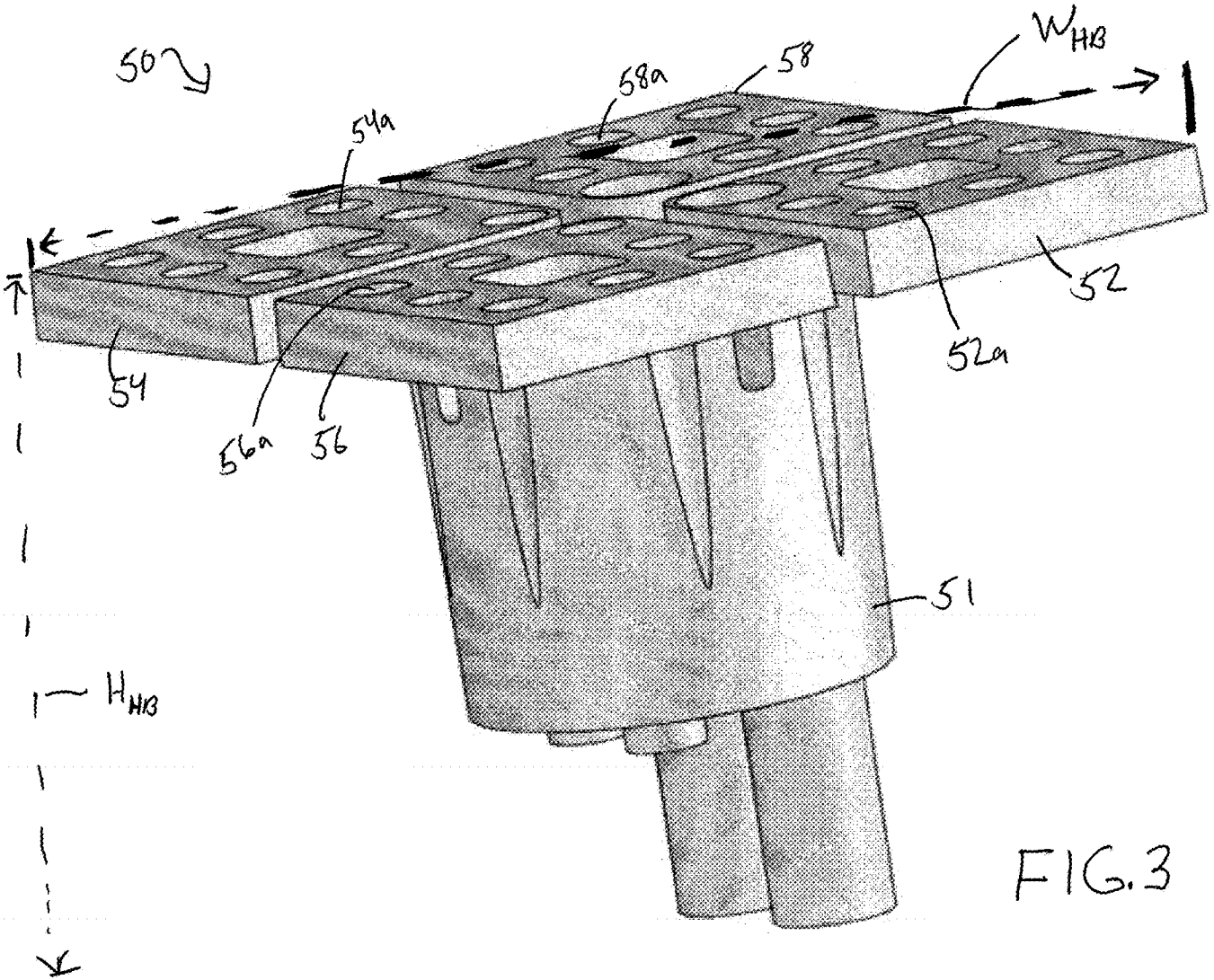
FIG. 3 is a perspective view of a high band dipole radiating element of the antenna of FIG. 1 according to an embodiment of the invention.

FIG. 3 shows a high band dipole 50 in greater detail in accordance with one embodiment of the invention. The high band dipole 50 may be constructed as a unitary structure formed by molding, casting, or carving, for example. In addition, the high band dipole 50 may be constructed using materials such as copper, bronze, plastic, aluminum, or a zamak alloy, for example. If the material used is a type that cannot be soldered, such as plastic or aluminum, then the high band dipole 50, once formed, may be covered or plated, in part or in whole, with a metallic material that may be soldered, such as copper, silver, or gold.

As shown in FIG. 3, in accordance with one embodiment, the high band dipole 50 may include four substantially square or rectangular arms 52, 54, 56, 58 attached to a base portion 51. This configuration may be referred to as a "four square" dipole design. The base portion 51 of the high band dipole may be attached to the chassis 10 by fasteners (e.g., screws) or soldering, for example. The arms 52, 54, 56 and 58 may extend radially, substantially horizontally, from the base portion 51.

The arms 52, 54, 56 and 58 may be arranged such that arm 52 is opposite arm 54, and arm 56 is opposite arm 58. The opposing arms may be wired (not shown) and positioned with respect to the base portion 51 (and the chassis 10) so as to transmit and/or receive RF energy/signals at two exemplary polarizations: a first polarization of +45 degrees and a second polarization of −45 degrees with respect to the base portion 51. For example, opposing arms 54 and 52 may correspond to the first and second polarization of the dipole 20, respectively. Likewise, opposing pairs 58 and 56 may correspond to the first and second polarizations, respectively. According to exemplary embodiments the high band dipole 50 is not limited to these polarizations. Changing the number, arrangement and position of the arms may change both the number of polarizations and the polarization angles of the dipole.

Still referring to FIG. 3, the arms 52, 54, 56, and 58 may be substantially flat, plate-shaped members. The arms 52, 54, 56 and 58 may each include a plurality of slots 52*a*, 54*a*, 56*a*, 58*a* in a fractal pattern such as a volume (three-dimensional) Sierpinski carpet pattern or other volume pattern, for example. Referring to FIGS. 1 and 3, according to an embodiment, the wingspan $W_{HB}$ of the arms 52, 54, 56, 58 may be about one-half of the wavelength (λ/2) of an operating frequency within the high frequency range. The electrical height $H_{HB}$ (See FIGS. 3 and 5) of the high band dipole 50 may be about one-fourth of the wavelength (λ/4) of an operating frequency within a high frequency range. However, the size and shape of high band dipole 50 and the arms 52, 54, 56, and 58 may vary from antenna to antenna and still be within the scope of the invention.

The base portion 51 of the high band dipole 50 may be designed and shaped to match a complimentary form on the chassis 10 so as to further facilitate the assembly of the antenna structure. The size and shape of the base portion 51 may vary from antenna to antenna and still be within the scope of the invention.

Figure 4:
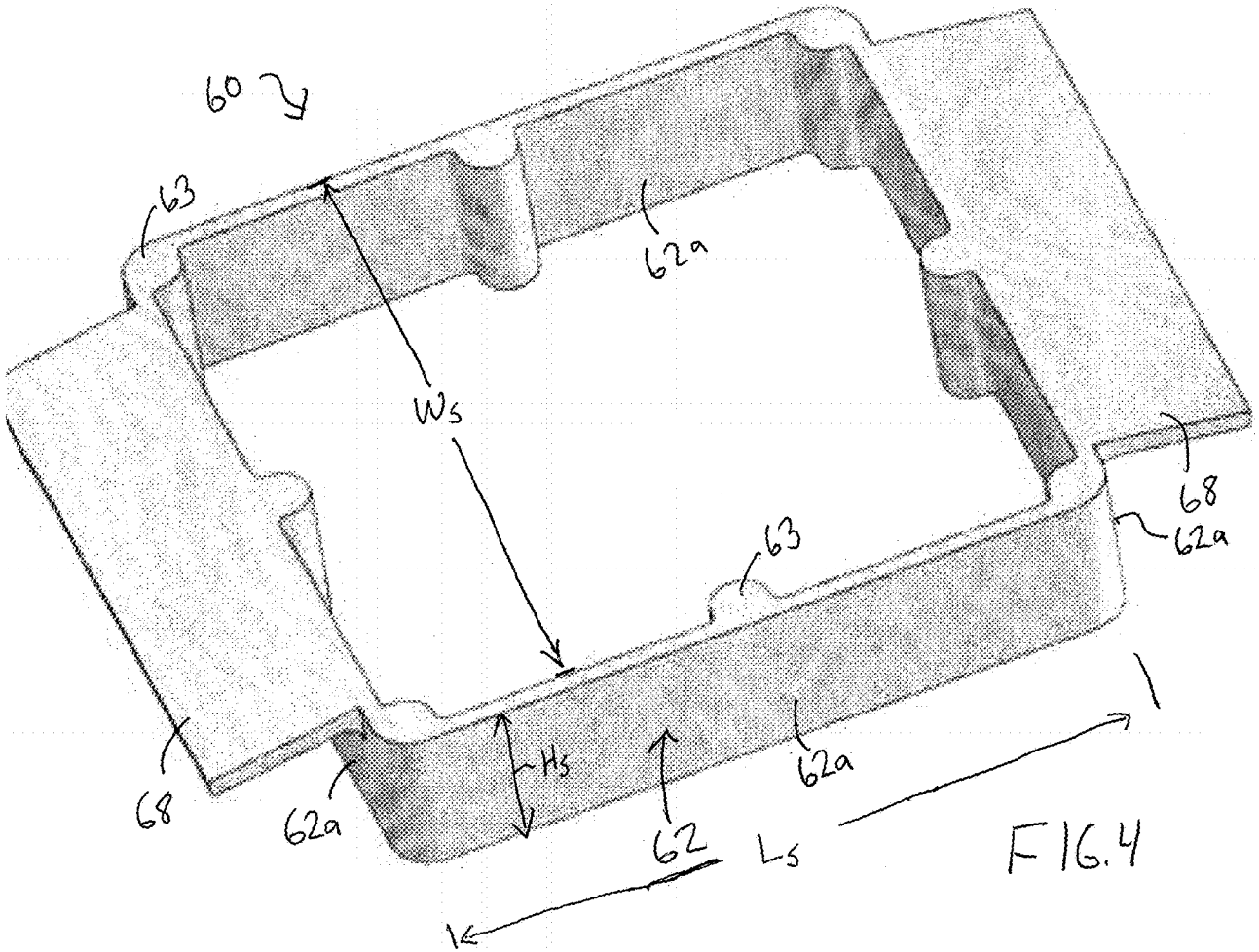
FIG. 4 is a perspective view of a shroud for the high band dipole radiating element of FIG. 3 according to an embodiment of the invention.

FIG. 4 illustrates a shroud 60 according to one embodiment. The shroud 60 may include a body portion 62 and a pair of wing members 68 attached to the body portion 62. The shroud 60 may be constructed as a unitary structure formed by molding, casting, or carving, for example. In addition, the shroud 60 may be constructed using materials such as copper, bronze, plastic, aluminum, or a zamak alloy, for example. If the material used is a type that cannot be soldered, such as plastic or aluminum, then the shroud 60, once formed, may be covered or plated, in part or in whole, with a metallic material that may be soldered, such as copper, silver, or gold. The shroud 60 may be made from the same material or a different material than the high band dipole 50.

As shown in FIG. 4, the body portion 62 of the shroud 60 may be hollow with a square cross-section in a horizontal plane. However, it should be understood that the body portion 62 may have other cross-sectional shapes, such as rectangular, circular, or oval, for example, in order to meet desired performance specifications such as beam width stability, input matching, cross-polarization within the high frequency band, and reduction of the resonance effect in the low band frequency. Mounting posts 63 may be provided on the body portion 62 for receiving fasteners (not shown), such as screws, for attaching the shroud 60 to the chassis 10. Alternatively, the shroud 60 may be soldered to the chassis 10. The wing members 68 may be attached to opposing sidewalls 62*a* of the body portion 62 and extend generally transversely to the sidewalls 62*a*. Thus, the two wing members 68 of each shroud 60 may be spaced apart in the direction of the length of the column A1 or A2 in which the shroud 60 may be located. The wing members 68 are shown to be substantially flat and rectangular in shape. However, it should be understood that the shape may vary from antenna to antenna in order to meet desired performance characteristics such as isolation of opposite polarities (e.g., +45 degrees and −45 degree polarities) of the high band dipole assemblies 40. Such shapes may include semi-circular, semi-oval, square and triangular shapes. Additionally, fewer or greater than two wing members 68 may be provided.

According to one embodiment, as shown in FIG. 4, the body portion 62 of the shroud 60 may have a width $W_S$ and length $L_S$ (or, diameter, if the shroud has a circular or oval cross-sectional shape) that are greater than the wingspan $W_{HB}$ of the arms 52, 54, 56, and 58 of the high band dipole 50 such that the arms 52, 54, 56, and 58 do not extend horizontally outside the perimeter of the body portion 62. Still referring to FIG. 5, the body portion 62 may have an electrical length or height $H_S$ of less than one-fourth of the wavelength (λ/4) of an operating frequency within a high frequency range. Accordingly, the physical height of the body portion 62 of the shroud 60 may be less than the physical height of the high band dipole 50.

Figure 6:
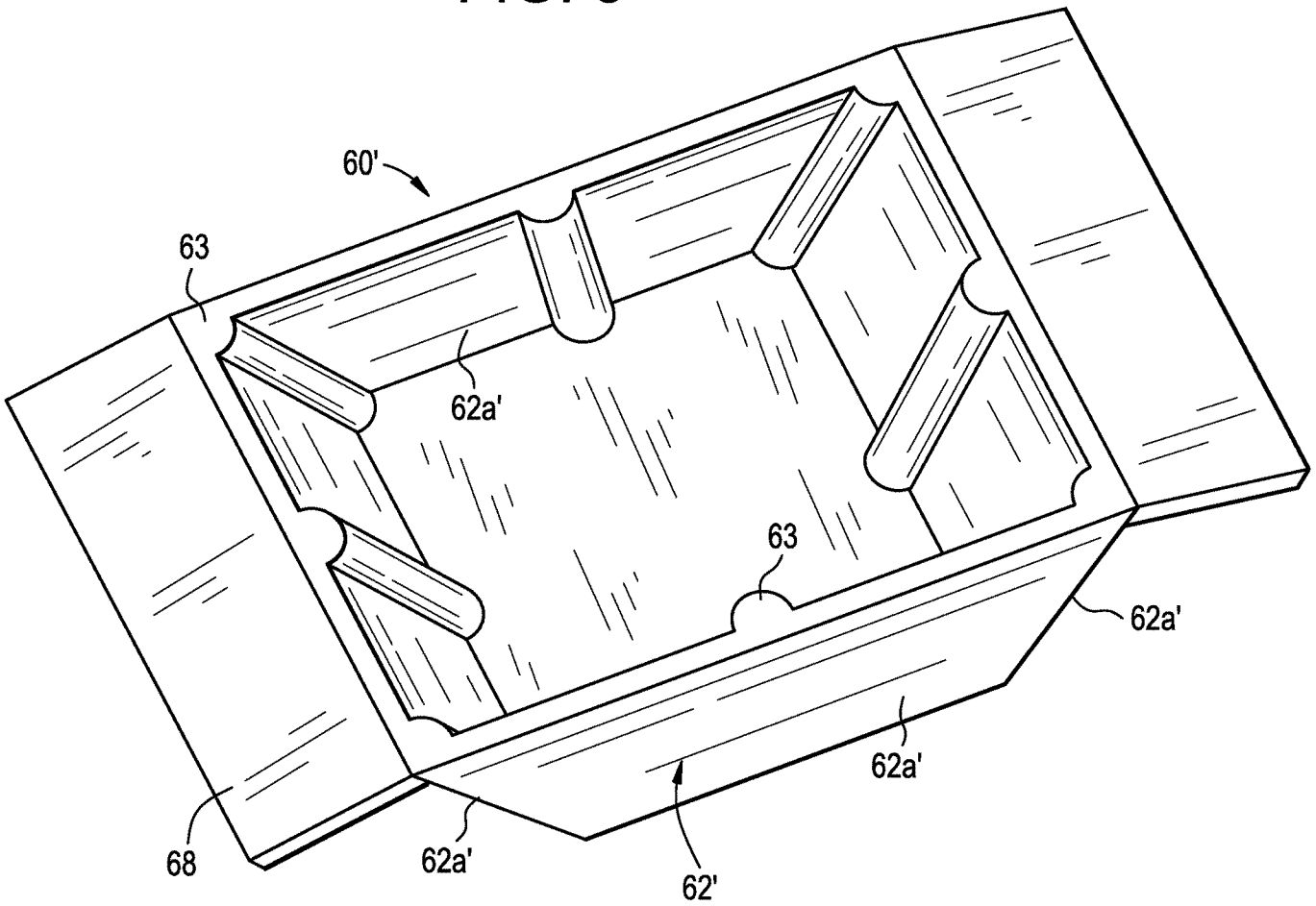
FIG. 6 is a perspective view of a shroud for a high band dipole radiating element according to an alternate embodiment of the invention.

FIG. 6 depicts an alternative shroud 60' that may be used in place of the shroud 60 in accordance with another embodiment. The shroud 60' includes a body portion 62' and wing members 68, and may be similar to the shroud 60, except that the body portion 62' of the shroud 60' includes sidewalls 62*a'* that taper inwardly from top to bottom. Thus, the sidewalls 62*a'* have a trapezoidal shape and the body portion 62' has a generally inverted conical profile. Although the shroud 60' is shown with a square horizontal cross-section, it should be understood that other variations of the shroud 60' including tapered sidewalls and rectangular, circular, oval, or other horizontal cross-sectional shapes are possible. Additionally, other variations of the shroud 60' may be possible, including variations with conical profiles in which the sidewalls of the shroud taper inwardly from bottom to top.

Figure 7:
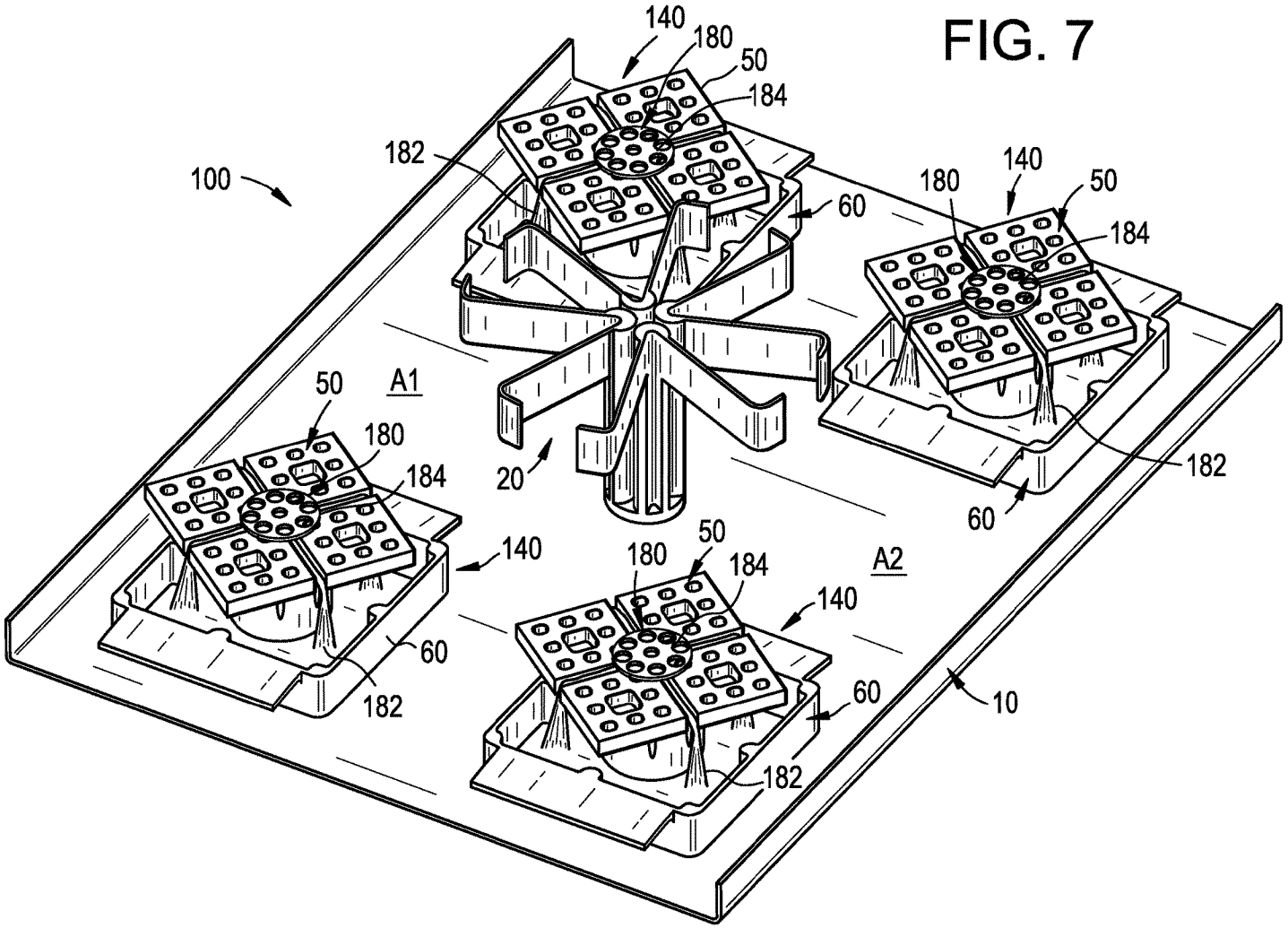
FIG. 7 is a perspective view of an antenna according to an alternate embodiment of the invention.

FIG. 7 shows an antenna 100 including a high band dipole assembly 140 according to another embodiment. The high band dipole assembly 140 may be similar to the high band dipole assembly 40 shown in FIG. 1, except that the high band dipole assembly 140 includes a passive radiator 180 configured to increase a gain of the high band dipole assembly 140. The passive radiator 180 may have a base portion 182 configured to be attached to the chassis 10 by fasteners or soldering, for example, and a passive radiating element 184 attached to the base portion 182. The passive radiating element 184 may be electrically isolated from the high band dipole 60 and may extend above the arms 52, 54, 56, 58 of the high band dipole 50. The passive radiating element 184 may be a substantially flat, disc-shaped member as shown in FIG. 7. However, it should be understood that the shape, size and orientation of the passive radiating element 184 may be varied from antenna to antenna in order to provide desired performance.

The configuration and construction of the antennas 1 and 100 according to the embodiments shown and described provide improved performance characteristics and tunability for various multi-band antenna applications. In particular, the antennas 1 and 100 provide improved performance when operating the low band dipole 20 in a low frequency range of about 698 MHz to about 960 MHz and operating the high band dipole in a high frequency range of about 1700 to about 2700 MHz. More specifically, the construction and configuration of the low band dipole 20 may provide improved cross-polarization in the low frequency range (greater than 10 dB at +/−60° with respect to main axis or bore sight). Additionally, the construction and configuration of the low band dipole 20 and the high band dipole assemblies 40, 140 cooperate to improve cross-polarization (greater than 10 dB at +/−60° with respect to main axis or bore sight) and beam width stability in the high frequency range. The shrouds 60, 60', in particular, work in conjunction with the low band dipole 20 and high band dipoles 40, 140 to improve beam width stability and cross-polarization in the high frequency range.

Additionally, the shrouds 60, 60' disclosed herein may be configured to provide improved isolation of opposite polarities (e.g., +45 degree and −45 degree polarities) of the high band dipole assemblies 40. The improved isolation characteristics may be achieved by the configuration and construction of the wing members 68, which may extend transversely to the polarization directions of the arms 52, 54, 56, 58 of the high band dipoles 50. Accordingly, the embodiments shown and described herein eliminate the need for separate isolation walls that may be commonly attached to or designed into the chassis of known antennas.

Furthermore, the configuration and construction of the shrouds 60, 60' may minimize or eliminate the common problem of low frequency resonance from high band dipoles generating interference in the operating frequency range of low band dipoles. For example, the shrouds 60, 60' may be configured such that the effective electrical length of the high band dipole assemblies 40, 140 may be about one-half of a wavelength ($\lambda/2$) of higher frequencies of the high frequency pass band (2200 MHz), thereby shifting low frequency resonance from the high band dipole assemblies 40, 140 below 680 MHz. Thus, resonance from the high band dipole assemblies 40, 140 may be shifted below the bottom end of the operating frequency range (about 698 MHz) of the low band dipole 20.

Still further, the shrouds 60, 60' may be configured to improve input matching to an input signal received by the high band dipole assemblies 40, 140.

The antenna 100 shown in FIG. 7 provides enhanced performance and design flexibility through the incorporation of passive radiators 180 in the high band dipole assemblies 140. The passive radiators 180 enable the gain of the high band dipole assemblies 140 to be increased with minimal or no adverse effects on other performance characteristics of the antenna 100.

It should be understood that the configuration and construction of the low band dipoles, high band dipole assemblies, shrouds and passive radiators disclosed herein may be altered from antenna to antenna in order to achieve desired performance with regard to cross-polarization, beam width stability, isolation of dipoles and resonance, input matching and other performance criteria.

As indicated above, the disclosed multi-band antennas 1, 100 may be configured such that the beam widths of the high band dipole assemblies and low band dipoles, isolation between the high band dipole assemblies, cross-polarization of the high band dipole assemblies and low band dipoles, low frequency resonance of the high band dipole assemblies, and input matching in the high band dipoles may be optimized. Due to the configuration of the low band dipole and the addition of the shrouds 60, 60' to the high band dipoles, the beam width of both the low band dipole and the high band dipole assemblies may be controlled more accurately. Particularly, the design of different beam width antennas that meet desired performance criteria for isolation, cross-polarization, resonance and input matching, for example, may be achieved by modifying the configuration and/or construction of the shrouds 60, 60' (and, optionally, the passive radiators 180) without completely changing the antenna or changing the radiating elements of the antenna.

A dimension, a shape, an angular relationship or a material associated with the wing members 68 may change the beam width of the antenna. For example, a width, a thickness, a shape or a material of the wing members 68 may be changed to optimize the beam width of the high band dipole assemblies 40, 140. In addition, a diameter or length and width of the hollow body 62 or 62' may be changed to optimize cross-polarization of the high band dipole assemblies.

The configuration of a shroud (such as shrouds 60, 60' of FIGS. 4 and 6) for the high band dipoles may be generally selected based on the configuration of models of the low band dipole (such as dipole 20 in FIG. 2), the high band dipoles (such as dipole 50 in FIG. 3) and the optional passive radiator (such as passive radiator 180 in FIG. 7). For example, a low band dipole, high band dipoles (optionally with passive radiators) and a shroud may be modeled using a known 3D computer aided drafting (CAD) system. The models may be merged together to generate an antenna as illustrated in FIGS. 1 and 7. Parameters associated with the merged model may then be ported to a known 3D Full-wave Electromagnetic Field Simulator. Antenna transmission signals may be simulated and magnetic fields results or simulated beams may be generated. The simulated beams may be analyzed for a desired beam widths of the dipoles, isolation, cross-polarization, resonance and input matching, for example.

The configuration dipole models, passive radiator models, and/or shroud models may then be modified and additional simulations run, resulting in revised simulated beams. The simulation and modification of dipole models, passive radiator models, and/or shroud models may be repeated until the desired beam width of the dipoles, isolation, cross-polarization, resonance and input matching may be achieved. The shroud or shroud model may be modified such that materials (e.g., different metals, plated plastic, loaded plastic or the like), dimensions (e.g., width, length, diameter, number of wing members, dimensions and shapes of wing member), or the shroud or shroud hollow body style may be changed. Similarly, the positioning, arrangement, shapes, dimensions and materials of dipole models and passive radiator models may be also be changed.

Figure 8:
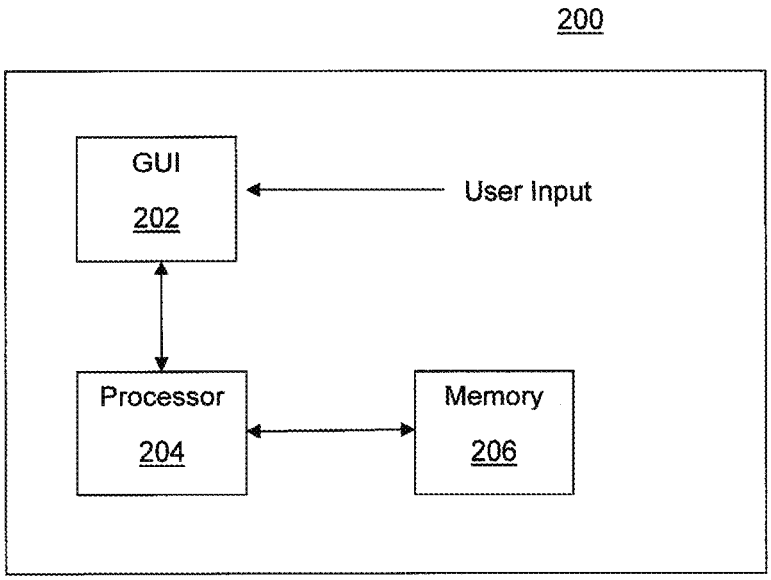
FIG. 8 shows a system for configuring a multi-band antenna according to an embodiment of the invention.

FIG. 8 illustrates a system 200 for designing an antenna according to at least one exemplary embodiment. The system 200 may include a graphical user interface (GUI) 202, a processor 204 in communication with the GUI 202 and memory 206 in communication with the processor 204. The system 200 may be a workstation, a server, a personal computer, or the like. The GUI 202 may be operable to receive user input from a keyboard, a mouse or another type of input device.

Figure 9:
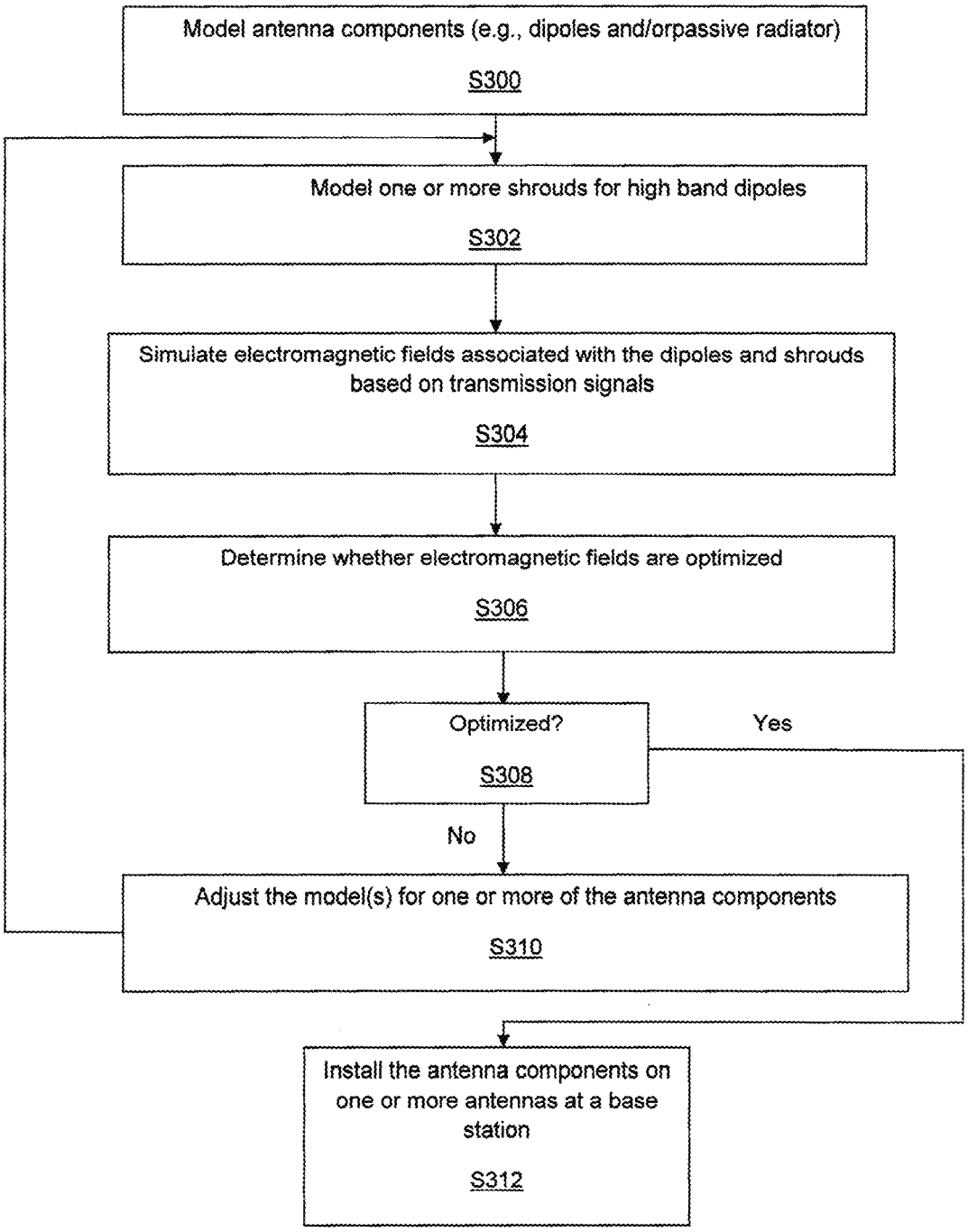
FIG. 9 illustrates a method for assembling an antenna according to an embodiment of the invention.

FIG. 9 illustrates a method for assembling an antenna according to an exemplary embodiment. Referring to FIG. 9, in step S300, antenna components (e.g., low band dipoles, high band dipoles and, optionally, passive radiators for the high band dipoles) may be modeled by a processor (e.g., processor 204 of FIG. 8). For example, the processor may be a part of a 3D computer aided drafting (CAD) system. Alternatively, the functions and features of the CAD system may be stored as instructions in memory 206. These instructions may be accessed and executed by processor 204. Inputs into the system may be made via GUI 202. IN general, modeling using a CAD system is known to those skilled in the art and will not be discussed in great detail for the sake of conciseness.

In step S302 the processor, in conjunction with stored instructions and user inputs, may model the shroud or baffle. For example, the shroud may be modeled using the 3D CAD system.

In step S304, the processor may simulate electromagnetic fields associated with the antenna based on transmission signals. For example, models generated by a CAD system may be merged together to form a system as illustrated in, for example, FIGS. 1 and 7. Parameters associated with the merged model may be then ported to a 3D Full-wave Electromagnetic Field Simulator or the like. Transmission signals may be simulated using an antenna and magnetic field results or simulated beams may be generated. The features and functions of the 3D Full-wave Electromagnetic Field Simulator may be implemented as instructions within memory 206, instructions that may be accessed and executed by processor 204.

In step S306, the processor may determine if electromagnetic fields may be optimized. For example, as discussed above, the simulated beams may be analyzed for, by way of example, desired beam widths of the dipoles, isolation, cross-polarization, resonance and input matching. If it is determined in step S308 that the electromagnetic fields may be not optimized, processing may continue to step S310. Otherwise, processing may move to step S312.

In step S310 a designer may adjust the model for one or more of the antenna components (e.g., the low band dipoles, the high band dipoles, the optional passive radiators and the shroud) and processing may then return to step S306. Alternatively, the processor may adjust the model(s) based on criteria previously entered by a user/design engineer. For example, the shroud model may be adjusted, using the CAD system, such that materials (e.g., different metals, plated plastic, conductive material loaded plastic or the like), dimensions (e.g., width, diameter, number of wing members, dimensions of the wing members), the shroud and/or shroud hollow body style may be changed. Alternatively, or additionally, the arrangement, shapes, dimensions and materials of dipole models and/or passive radiator models may be changed.

In step S312, the antenna components may be mounted on a chassis to form an antenna at a base station, for example. According to an alternative embodiment, one or more of the antenna components may be manufactured based on the final models and may be installed as replacement components or supplemental components in one or more existing antennas at a base station, for example. One or more signal characteristics (e.g., beam width of the dipoles, isolation, cross-polarization, resonance and input matching) may be measured before and after the components may be installed.

While exemplary embodiments have been shown and described herein, it should be understood that variations of the disclosed embodiments may be made without departing from the spirit and scope of the claims that follow.

We claim:

1. An antenna radiating element for a mobile communication antenna, comprising:

a base portion configured to be attached to a chassis; and at least two forked arms attached to the base portion, each of the at least two forked arms including, a proximal end connected to the base portion, a distal end radially spaced from the base portion, wherein the forked arm portions comprise a unitary structure that includes a vertex where the at least two forked arms meet, each of the at least two forked arms comprising, a first radial arm portion extending radially from the proximal end to the distal end, a first transverse arm portion connected to the first radial arm portion at the distal end, the first transverse arm portion extending transversely from the first radial arm portion, a second radial arm portion connected to the first radial arm portion at a vertex of the proximal end, the second radial arm portion extending radially from the proximal end to the distal end and forming an acute angle with respect to said first radial arm portion, and a second transverse arm portion connected to the second radial arm portion at the distal end, the second transverse arm portion extending transversely from the second radial arm portion, said first and second transverse arm portions disposed to diverge from one another.

2. The antenna radiating element of claim 1, wherein the antenna radiating element is a dipole antenna radiating element.

3. The antenna radiating element of claim 1, wherein the at least two forked arms comprise:

a first forked arm;

a second forked arm opposite the first forked arm;

a third forked arm; and a fourth forked arm opposite the third forked arm, wherein the first, second, third and fourth forked arms are wired and positioned so as to transmit and receive RF energy at a first polarization and a second polarization, wherein the first and second forked arms correspond to the first polarization, and wherein the third and fourth forked arms correspond to the second polarization.

4. The antenna radiating element of claim 1, wherein the first and second transverse arm portions are configured to improve cross-polarization of the antenna radiating element.

5. The antenna radiating element of claim 1, wherein the antenna radiating element is configured to operate in a frequency range of about 698 MHz to about 960 MHz.

6. An antenna comprising:

a chassis;

at least one low band radiating element mounted on the chassis, the at least one low band radiating element being configured to transmit and receive RF signals in a low frequency range and positioned in a center of an array of high band radiating assemblies; and a two dimensional array of high band radiating assemblies mounted on the chassis around the low band radiating element, the high band radiating assemblies being configured to transmit and receive RF signals in a high frequency range, each of the high band radiating assemblies comprising, a high band radiating element, and a shroud surrounding the high band radiating element, the shroud comprising a sidewall element completely surrounding the high band radiating element and at least one wing member extending substantially perpendicularly from the sidewall of the shroud.

7. The antenna of claim 6, wherein the at least one low band radiating element and each of the high band radiating elements comprise dipole radiating elements.

8. The antenna of claim 6, further comprising a number of two-dimensional arrays of high band radiating assemblies, and a number of low band radiating elements, each low band radiating element positioned in a center of at least one of the arrays.

9. The antenna of claim 6, wherein:

the at least one low band radiating element comprises a base portion mounted on the chassis, and at least two forked arms attached to the base portion and extending radially from the base portion, and comprising a unitary structure that includes a vertex where the at least two forked arms meet, each of the at least two forked arms comprising a first forked arm, a second forked arm opposite the first forked arm, a third forked arm, and a fourth forked arm opposite the third forked arm;

wherein the first, second, third and fourth forked arms are wired and positioned so as to transmit and receive RF energy at a first polarization and a second polarization;

the first and second forked arms correspond to the first polarization and the third and fourth forked arms correspond to the second polarization;

the high band radiating element comprises a first plate-shaped arm, a second plate-shaped arm opposite the first plate-shaped arm, a third plate-shaped arm, and a fourth plate-shaped arm opposite the third plate-shaped arm;

wherein the first, second, third and fourth plate-shaped arms are wired and positioned so as to transmit and receive RF energy at the first polarization and the second polarization; and the first and second plate-shaped arms correspond to the first polarization and the third and fourth plate-shaped arms correspond to the second polarization.

10. The antenna of claim 9, wherein each of the at least two forked arms comprises:

a proximal end connected to the base portion;

a distal end radially spaced from the base portion;

a first radial arm portion extending radially from the proximal end to the distal end;

a first transverse arm portion connected to the first radial arm portion at the distal end, the first transverse arm portion extending transversely from the first radial arm portion;

a second radial arm portion connected to the first radial arm portion at a vertex of the proximal, the second radial arm portion extending radially from the proximal end to the distal end forming an acute angle with respect to said first radial arm portion; and a second transverse arm portion connected to the second radial arm portion at the distal end, the second transverse arm portion extending transversely from the second radial arm portion.

11. The antenna of claim 10, wherein the first and second transverse arm portions are configured to improve cross-polarization of the low band radiating element and beam width stability of the high band radiating assembly.

12. The antenna of claim 6, wherein the shroud is configured to achieve at least one of the following: shift resonance from the high band radiating assembly below a bottom end of the low frequency range; improve beam width stability of the high band radiating assembly; improve cross-polarization of the high band radiating assembly; improve input matching to an input signal received by the high band radiating assembly; and improve isolation between polarizations of the high band radiating assembly.

13. The antenna of claim 6, wherein the shroud comprises a hollow body within the sidewall and the at least one wing member is connected to the hollow body and extends transversely from the sidewall of the shroud.

14. The antenna of claim 13, wherein the hollow body has one of a substantially square horizontal cross section, a substantially rectangular horizontal cross section, a substantially circular horizontal cross section, and a substantially oval horizontal cross section.

15. The antenna of claim 13, wherein the hollow body has one of a substantially conical profile and a substantially inverted conical profile.

16. The antenna of claim 13, wherein the at least one wing member comprises two wing members disposed on opposite sides of the hollow body, and wherein the two wing members are spaced apart.

17. The antenna of claim 6, wherein each of the high band radiating assemblies comprises a passive radiator configured to increase a gain of the respective high band radiating assembly.

18. The antenna of claim 6, wherein the shroud is constructed from one of a conductive material, a non-conductive material plated with a conductive material and a non-conductive material loaded with a conductive material.

19. The antenna of claim 6, wherein the low frequency range is about 698 MHz to about 960 MHz and the high frequency range is about 1700 MHz to about 2700 MHz.

20. A method of assembling an antenna comprising:

mounting at least one low band radiating element mounted on a chassis, the at least one low band radiating element being configured to transmit and receive RF signals in a low frequency range and positioned in a center of an array of high band radiating assemblies; and mounting a two-dimensional array of high band radiating assemblies on the chassis around the low band radiating element, each of the high band radiating assemblies being configured to transmit and receive RF signals in a high frequency range, and each of the high band radiating assemblies comprising:

a high band radiating element, and a shroud surrounding the high band radiating element, the shroud comprising a sidewall element completely surrounding the high band radiating element and at least one wing member extending substantially perpendicularly from the sidewall of the shroud.

21. The method of claim 20, wherein the at least one low band radiating element and each of the high band radiating elements are dipole radiating elements.

22. The method of claim 20, wherein the antenna comprises a number of two-dimensional arrays of high band radiating assemblies, and a number of low band radiating elements, each low band radiating element positioned in a center of at least one of the arrays.

23. The method of claim 20, wherein:

the at least one low band radiating element comprises a base portion mounted on the chassis, and at least two forked arms attached to the base portion and extending radially from the base portion, wherein the at least two forked arm portions comprise a unitary structure that includes a vertex where the at least two forked arms meet, the at least two forked arms comprising a first forked arm, a second forked arm opposite the first forked arm, a third forked arm, and a fourth forked arm opposite the third forked arm;

the first, second, third and fourth forked arms are wired and positioned so as to transmit and receive RF energy at a first polarization and a second polarization;

the first and second forked arms correspond to the first polarization;

the third and fourth forked arms correspond to the second polarization; and the high band radiating element comprises a first plate-shaped arm, a second plate-shaped arm opposite the first plate-shaped arm, a third plate-shaped arm, and a fourth plate-shaped arm opposite the third plate-shaped arm;

the first, second, third and fourth plate-shaped arms are wired and positioned so as to transmit and receive RF energy at the first polarization and the second polarization;

the first and second plate-shaped arms correspond to the first polarization; and the third and fourth plate-shaped arms correspond to the second polarization.

24. The method of claim 23, wherein each of the at least two forked arms includes:

a proximal end connected to the base portion;

a distal end radially spaced from the base portion;

a first radial arm portion extending radially from the proximal end to the distal end;

a first transverse arm portion connected to the first radial arm portion at the distal end, the first transverse arm portion extending transversely from the first radial arm portion; and a second radial arm portion connected to the first radial arm portion at a vertex of the proximal end, the second radial arm portion extending radially from the proximal end to the distal end forming an acute angle with respect to said first radial arm portion; and a second transverse arm portion connected to the second radial arm portion at the distal end, the second transverse arm portion extending transversely from the second radial arm portion.

25. The method of claim 24, wherein the first and second transverse arm portions are configured to improve cross-polarization of the low band radiating element and beam width stability of the high band radiating assembly.

26. The method of claim 20, wherein the shroud is configured to achieve at least one of the following: shift resonance from the high band radiating assembly below a bottom end of the low frequency range; improve beam width stability of the high band radiating assembly; improve cross-polarization of the high band radiating assembly; improve input matching to an input signal received by the high band radiating assembly; and improve isolation between polarizations of the high band radiating assembly.

27. The method of claim 20, wherein the shroud comprises a hollow body within the sidewall and the at least one wing member is connected to the hollow body and extends transversely from the sidewall of the shroud.

28. The method of claim 27, wherein the hollow body has one of a substantially square horizontal cross section, a substantially rectangular horizontal cross section, a substantially circular horizontal cross section, and a substantially oval horizontal cross section.

29. The method of claim 27, wherein the hollow body has one of a substantially conical profile and a substantially inverted conical profile.

30. The method of claim 27, wherein the at least one wing member comprises two wing members disposed on opposite sides of the hollow body, and wherein the two wing members are spaced apart.

31. The method of claim 20, wherein the high band radiating assembly comprises a passive radiator configured to increase a gain of the high band radiating assembly.

32. The method of claim 20, wherein the shroud is constructed from one of a conductive material, a non-conductive material plated with a conductive material and a non-conductive material loaded with a conductive material.

33. The method of claim 20, wherein the low frequency range is about 698 MHz to about 960 MHz and the high frequency range is about 1700 MHz to about 2700 MHz.

* * * * *